United States Patent [19]

Davis

[11] 4,391,186

[45] Jul. 5, 1983

[54] COTTON PRESS

[76] Inventor: William R. Davis, P.O. Box 131, Charleston, Mo. 63834

[21] Appl. No.: 207,629

[22] Filed: Nov. 17, 1980

[51] Int. Cl.[3] ..... B65B 13/18

[52] U.S. Cl. ..... 100/7; 100/3; 100/102; 100/215; 100/218; 100/255; 100/264; 100/295

[58] Field of Search ..... 100/3, 8, 215, 214, 100/218, 224, 255, 7, 25, 26, 264, 236, 37, 256, 269 R, 53, 295, 102

[56] References Cited

U.S. PATENT DOCUMENTS

| | | | |
|---|---|---|---|
| 2,219,709 | 10/1940 | Lee | 100/269 R X |
| 2,410,694 | 11/1946 | Tyler | 100/224 X |
| 2,728,287 | 12/1955 | Tillinghast . | |
| 2,812,708 | 11/1957 | Tillinghast . | |
| 2,907,530 | 10/1959 | Pyles | 100/218 |
| 3,016,005 | 1/1962 | Tomka et al. . | |
| 3,051,076 | 8/1962 | West | 100/255 X |
| 3,159,097 | 12/1964 | White | 100/214 |
| 3,220,337 | 11/1965 | Goland et al. . | |
| 3,521,550 | 7/1970 | van Doorn | 100/26 |
| 3,590,731 | 7/1971 | Nichols | 100/215 |
| 3,673,950 | 7/1972 | Koehler | 100/7 |
| 3,710,710 | 1/1973 | Koehler et al. . | |
| 3,772,983 | 11/1973 | Nichols | 100/295 X |
| 3,802,335 | 4/1974 | Longo . | |
| 3,916,781 | 11/1975 | Cerniglia . | |
| 4,090,440 | 5/1978 | Jensen | 100/7 |
| 4,092,912 | 6/1978 | Simich | 100/3 |

*Primary Examiner*—Billy J. Wilhite

*Attorney, Agent, or Firm*—G. Turner Moller

[57] ABSTRACT

A conventional Webb cotton press is modified to change the path of bale movement 90°. In additon, an improved debander is located adjacent the new entry location to the press. At the end of one cycle of press operation, a pusher associated with the debander advances a debanded bale into the press which pushes the finished bale out of the press. A heading mechanism is provided to square an unbanded bale push into the press.

18 Claims, 11 Drawing Figures

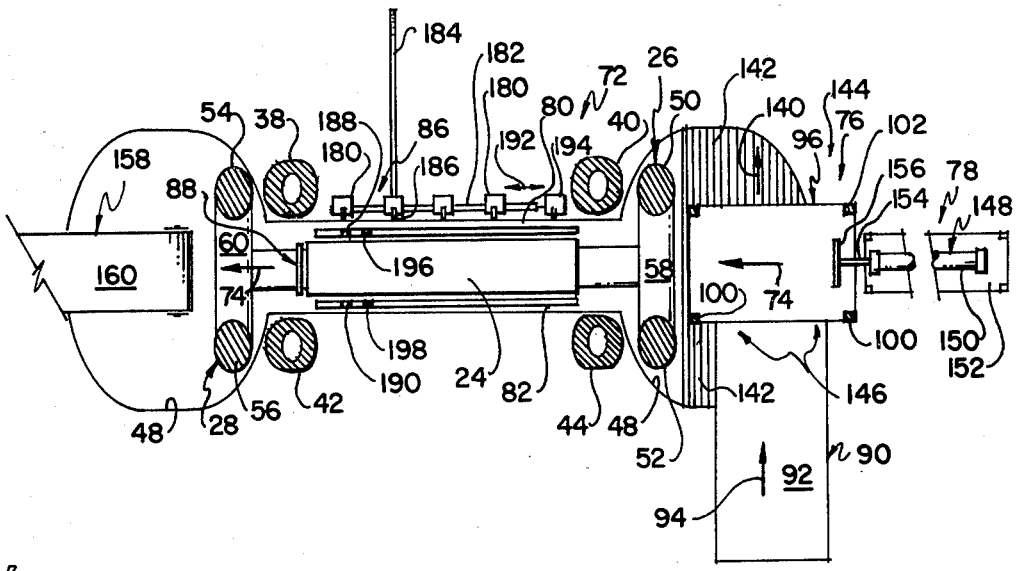
FIG. 4
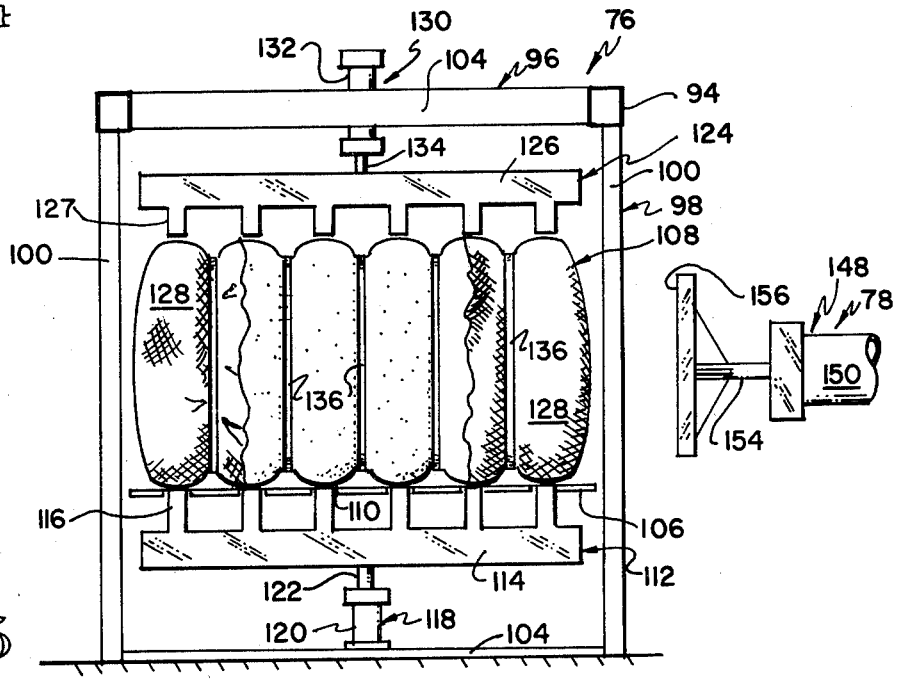
FIG. 5
FIG. 7
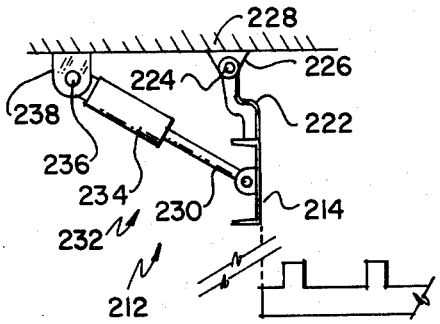
FIG. 8
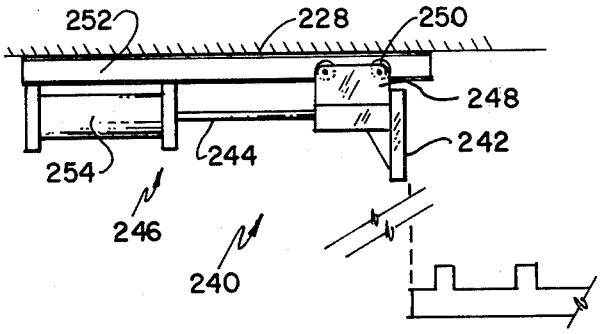

COTTON PRESS

This invention relates to improved cotton presses and more particularly to a modified Webb press.

As is well known in the cotton industry, cotton is delivered by a farmer to a gin where cotton fibers are removed from seeds, debris and the like. Until quite recently, cotton was universally compacted at a gin into a bale of approximately 500 pounds having a density of 19–23 pounds/cubic foot. Those gin bales which are to be shipped great distances are then transported to what is known as a cotton compress where the bale is further compressed to 28 pounds/cubic foot. This additional compacting step done at a compress is to conserve shipping space since gin bales are quite bulky and transportation economies can be effected by the additional compacting step conducted at a compress.

Although there has been recently introduced to the cotton industry a cotton press suitable for use at gins to produce a bale of 28 pounds/foot thereby obviating to some extent the requirement for cotton compresses, by far the bulk of cotton bales transported any significant distance still pass through a cotton compress for the additional compacting step.

The standard cotton press used today in compresses was originally designed in the latter part of the 19th century and is known as a Webb 80 press. Substantially all of the presses used in cotton compresses today were fabricated and installed before 1920. The typical Webb 80 press in use today in the United States has not been substantially modified beyond the design of the early 1900's.

It is quite amazing to those unversed in the cotton industry that presses of such antiquity can, with an experienced crew, average pressing about 100 bales per hour which, of course, approaches compressing 2 bales per minute. It is a tribute to the design and sturdy manufacture of these presses that they continue in use today. It is obviously no exaggeration to state that these presses have withstood the test of time.

At present, there are three significant disadvantages of the Webb 80 press currently used. First, since the press is steam actuated and includes a main stream cylinder of impressive size, steam consumption and consequently fuel consumption is substantial. Second, the standard Webb 80 press requires a crew of approximately 30 people to operate at an average throughput of about 100 bales per hour. Since the cotton pressing season in most compresses is fairly short, for example three months, it has become extremely difficult to attract and retain a crew approaching a semblance of needed experience. Third, a more dangerous implement is probably not now in wide use in the United States. It is somewhat surprising that the accident rate involving cotton presses is quite low. The explanation for this phenomenon is that the press is so clearly dangerous that workmen quickly learn to be careful and that workmen look out for each other.

Typical developments in cotton compresses are shown in U.S. Pat. Nos. 2,219,709; 3,051,076; 3,590,731; 3,772,983 and 4,092,912.

As will be more fully pointed out hereinafter, the modifications made by this invention to the conventional Webb press fall into a number of catagories. The most basic change is to reroute the path of bale movement through the press. In a conventional Webb press, bale movement is perpendicular to the doors when the doors are in the upright position. By this invention, an unbanded cotton bale is advanced between the links of the Webb press when the bottom platen is in the down position. As an unbanded bale is advanced into the press, the bale which has been compressed by the preceding cycle of press operation is pushed out of the press onto a conveyor belt.

Another feature of this invention comprises an improved dinky press or debanding station where the bands of a conventional gin bale are removed. One feature of this debanding station is that the platens are configured to allow workmen to remove the bands of a gin bale while the bale is in the press. Another feature of the improved debanding station of this invention is that a pusher member is positioned to push the unbanded bale into the press immediately upon debanding and upon the termination of downward movement of the main press platen.

Another feature of this invention comprises a heading device which acts to square an unbanded bale as it is pushed into the main cotton press. It has been learned that without such a heading device, the unbanded bale assumes a somewhat trapezoidal configuration and that the finished bale assumes a similar configuration. Although such a bale can normally be stood on one end, it cannot be stood upright on the other end. By the use of the heading device of this invention, bales of substantially rectilinear configuration are produced.

Another feature of this invention involves the incorporation of automatic banding equipment in a Webb 80 press. Automatic banding equipment is, of course, known in the cotton industry but has apparently only been used previously in conjunction with the newly designed cotton presses that are used in cotton gins.

Another feature of this invention is that the operation of the press has been substantially automated. The requirement for workmen in the modified Webb press of this invention fall into several catagories: (1) those individuals handling gin bales and delivering the same adjacent the debanding station; (2) those individuals working at the debanding station to remove bands from gin bales; (3) those individuals handling finished bales and carrying them away from the press; and (4) a single press operator who basically watches a control panel. It will accordingly be evident that the requirement for workmen is substantially reduced. Typically, a crew of 12–15 workers is adequate to operate a press of this invention. Since no workman need be close to the main press, the potential for substantial injury is vastly reduced. Furthermore, the need for skilled experienced personnel is almost eliminated.

It is an object of this invention to provide an improved or modified Webb cotton press.

Another object of this invention is to provde an improved debanding station for use with cotton presses.

A further object of this invention is to provide an improved technique for moving unbanded bales from the debanding station into the press.

A still further object of this invention is to provide an improved technique for removing finished bales from the press.

Another object of the invention is to provide a modified Webb press which is substantially automated.

A further object of the invention is to incorporate automatic banding equipment in a Webb press.

Other objects and advantages of this invention will become more fully apparent as this description proceeds, reference being made to the accompanying drawings and appended claims.

IN THE DRAWINGS

FIG. 4 is an enlarged cross-sectional view of the press of FIG. 3 taken substantially along line 4—4 of FIG. 3;

FIG. 5 is a side elevational view of the improved debanding station of this invention;

FIG. 7 is a side elevational view of one form of heading device in accordance with this invention;

FIG. 8 is a side elevational view of another embodiment of the heading device of this invention;

Figure 1:
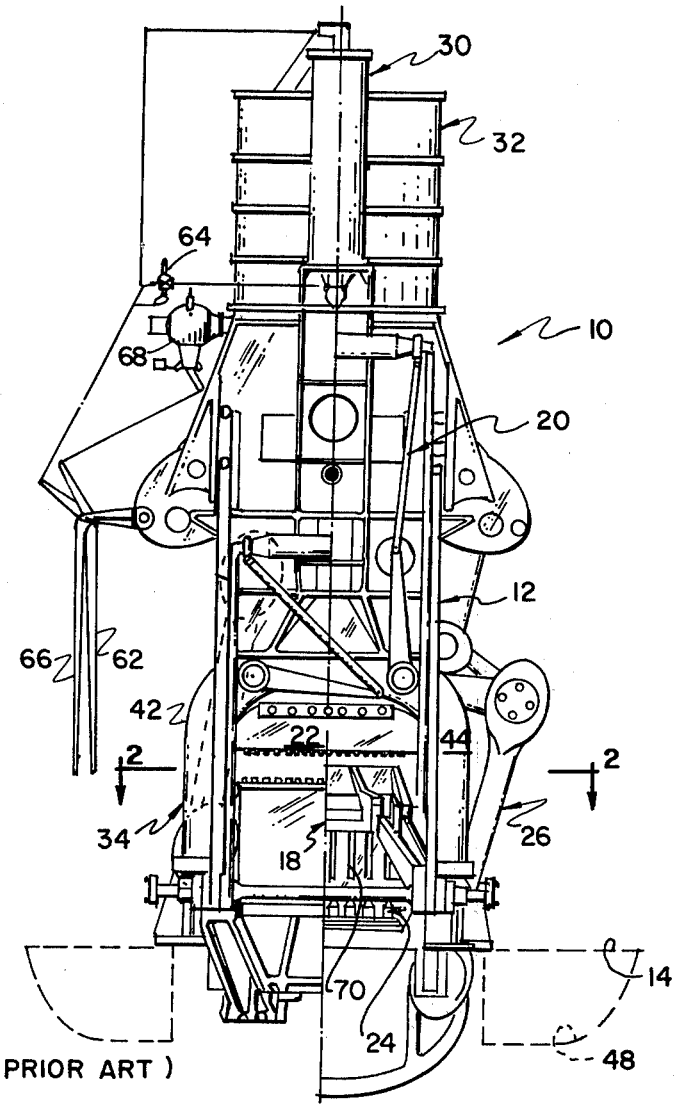
FIG. 1 (PRIOR ART)
FIG. 1 is an elevational view illustrating a conventional Webb 80 press in which the left part of the drawing illustrates the doors in the down position and right part of the drawing illustrates the doors in the up position.
Figure 2:
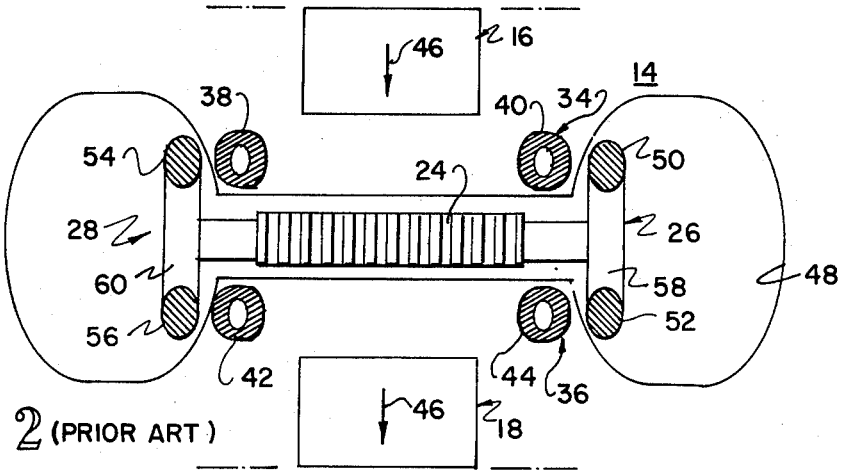
FIG. 2 (PRIOR ART)
FIG. 2 is an enlarged cross-sectional view of the press of FIG. 1 taken substantially along line 2—2 as viewed in the direction indicated by the arrows and illustrating the machine configuration when the doors are in the down position.

Referring to FIGS. 1 and 2, there is illustrated a conventional Webb 80 press 10 which is symmetrical in the sense that the front and back are mirror images. The press 10 comprises, as major components, a frame 12 supported by a floor 14, a pair of movable partitions or doors 16, 18, a pair of linkage arrangements 20 on each side of the press 10 for moving the doors 16, 18 from a generally horizontal position flush with the floor 14 to the upright position illustrated in the right of FIG. 1, a stationary platen 22 carried by the frame 12, a movable platen 24 mounted for vertical upward compressing movement toward the stationary platen 22, a pair of linkage arrangements 26, 28 on each side of the press 10 for moving the platen 24 in an upward compressing direction, a pair of steam cylinders 30 on opposite sides of the press 10 for moving the doors 16, 18 through the linkages 20, and a main power cylinder 32 which includes a piston (not shown) connected to the linkages 26, 28 for moving the linkages 26, 28 and platen 24 in the upward compressing direction.

The frame 12 includes a pair of spaced aligned inverted U-shaped frame members 34, 36 having spaced upstanding legs 38, 40 42, 44 which define a path of bale movement 46 into and out of the press 10. It is evident that the path of movement 46 is perpendicular to the opening provided by each U-shaped member 34, 36.

As shown best in FIG. 2, part of the linkage arrangements 26, 28 as well as the movable platen 24 (when in the down position) are located below the level of the floor 14 in a depression or pit 48. As is well known to those skilled in the art, the linkage arrangements 26, 28 each include a pair of upstanding links 50, 52, 54, 56 which are generally aligned with the U-shaped frames 34, 36 and a cross link 58, 60 which interconnect the bottoms of the links 50, 52 and 54, 56 respectively. The movable platen 24 is connected to the cross links 58, 60 and carried upwardly during upward movement of the linkage arrangements 26, 28.

Operation of the conventional Webb press 10 may be summarized as follows. A debanding crew operates a dinky press (not shown) spaced from the Webb press 10. Conventional dinky presses include smooth platen that are advanced against the gin bale to relax the stress on the bands. The bands are then unbuckled and the press platens retracted. The bale is then dumped onto the floor 14 and crewmen pull the bands from underneath the bale. The bale is then loaded onto a hand cart. With the doors 16, 18 and movable platen 24 in the down position illustrated in FIG. 2, a workman rolls the hand cart across the entry door 16 in the direction of the arrow 46 and dumps the bale into the pit 48 on top of the platen 24.

The press operator, known as a leverman, moves a first lever 62 to open a first steam valve 64 to deliver steam to the door cylinders 30 thereby actuating the linkages 20 to elevate the doors 16, 18 to the position shown in the right of FIG. 1. With the doors 16, 18 in the upright position, the leverman moves a second lever 66 which opens a main steam valve 68 to deliver steam to the power cylinder 32. As steam enters the power cylinder 32, its piston (not shown) rises inside the cylinder 32 to activate the linkages 26, 28 to move the platen 24 upwardly toward the stationary platen 22. When the platen 24 reaches its uppermost position, workmen thread banding material through slots 70 in the doors 16, 18 to encircle the bale inside the press. The free ends of the bands are then connected together. The leverman then actuates the lever 66 to exhaust steam from the main cylinder 32 which causes the linkages 26, 28 to move by gravity thereby moving the platen 24 away from the stationary platen 22. The leverman also actuates the lever 62 to exhaust steam from the door cylinders 30 whereupon the doors 16, 18 retract to the horizontal position illustrated in the left of FIG. 1 and as illustrated in FIG. 2. A workman then pushes or kicks the finished bale off the platen 24 onto the exit door 18 so that the bale moves in the direction indicated by the arrow 46. The finished bale is then moved from the exit door 18 and the process is repeated. The process is quite rapid and requires much longer to describe than to occur. As mentioned previously, an experienced crew can average 100 bales/hour through a conventional Webb press. The preceding description of the Webb press 10 will be recognized by those skilled in the art as exemplary of standard Webb press operation.

Figure 3:
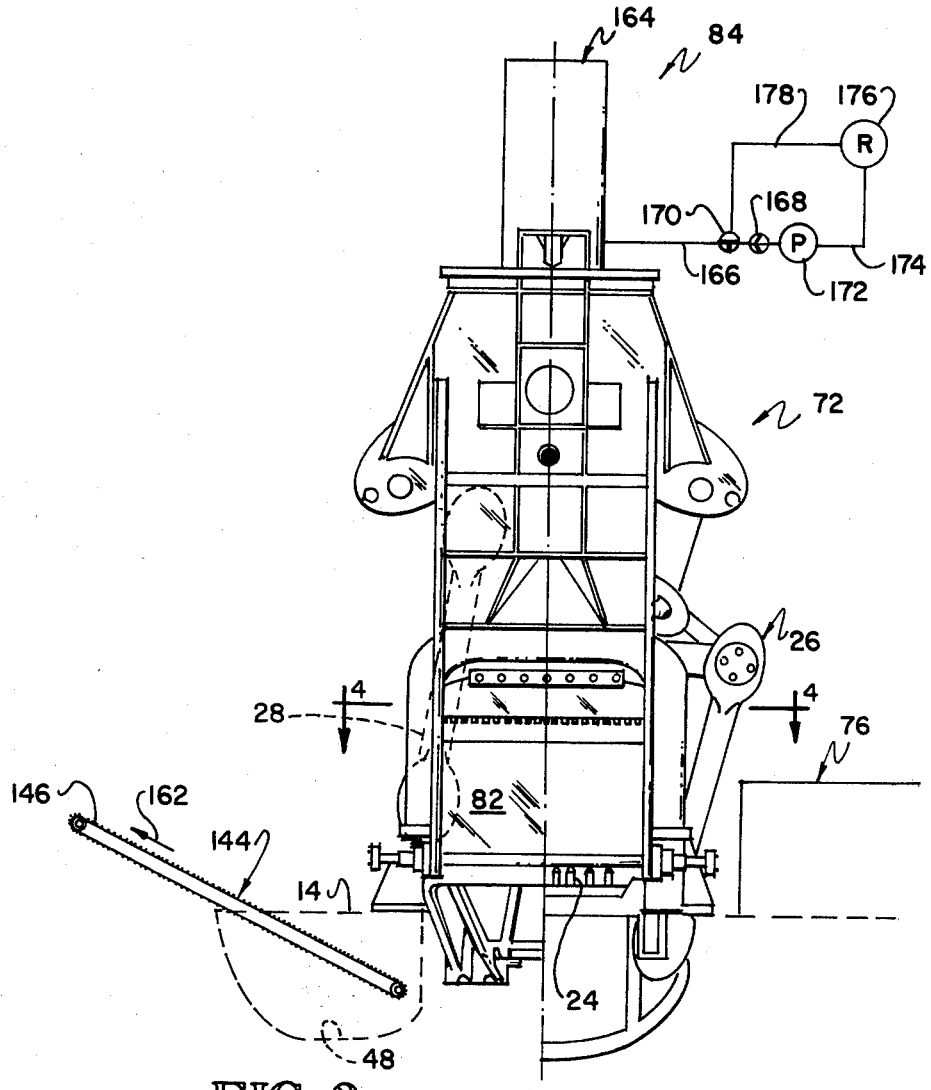
FIG. 3 is a view similar to FIG. 1 and illustrating the modified Webb press of this invention, the right part of the drawing illustrating the configuration of the device in the platen down position and the left part of the drawing illustrating the device in the platen up position.

Referring to FIG. 3, there is illustrated a conventional Webb press 72 which has been modified in accordance with this invention. The right part of FIG. 3 illustrates the press 72 in the platen down position while the left part of FIG. 3 illustrates the platen up position. Referring to FIGS. 3 and 4, the major modifications to the conventional Webb press are apparent: (1) the path of bale movement has been changed 90° so that the path of bale movement is shown by the arrows 74; (2) a debanding station 76 is located adjacent one side of the press 72; (3) unbanded cotton bales are fed into the press 72 by a feeding mechanism 78; (4) the doors 16, 18 have been removed and replaced by relatively stationary vertical walls 80, 82; (5) a finished bale is discharged from the press 72 in the path of movement 74 by pushing an unbanded bale into the press 72; (6) the linkages 20 and door cylinders 30 have been removed; (7) the main steam cylinder 32 and associated steam control equipment has been removed and replaced with a hydraulic power mechanism 84; (8) an automatic banding station 86 is positioned adjacent the wall 80 to automatically wrap each compressed bale with conventional banding material; and (9) a heading device 88 is positioned adjacent the discharge end of the platen 22.

DEBANDING STATION

Referring to FIGS. 4 and 5, the debanding station 76 is illustrated in greater detail. The debanding station 76 comprises an inlet conveyor 90 including an endless belt 92 periodically driven in the direction indicated by the arrow 94 upon closing of a suitable switch (not shown) by a workman.

The debanding station 76 also comprises a debander 96 including a frame 98 comprised of a plurality of upstanding columns 100, 102 interconnected by horizontal beams 104. Platework 106 is supported on the frame 98 slightly below, or at the same, elevation as the conveyor belt 92 so that a conventional gin bale 108 readily passes from the conveyor 90 onto the platework 106.

Figure 6:
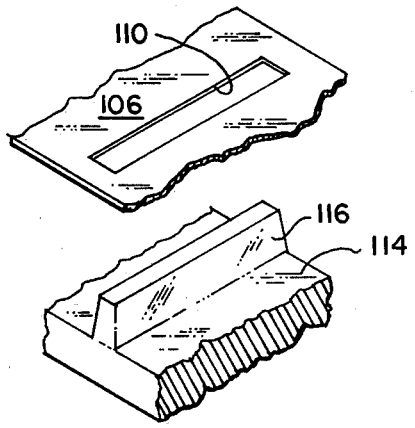
FIG. 6 is an isometric view of part of the debanding station of FIG. 5.

The platework 106 includes a plurality of elongate slots 110 which extends substantially across the width of the bale 108. Below the platework 106 is a lower movable upwardly facing platen 112 including a frame 114 having a plurality of upwardly facing projections 116 rigid therewith. The projections 116 are sized to pass through the slots 110 and preferably comprise an elongate rectilinear structure as shown best in FIG. 6. A suitable linear motor 118 connects the frame 114 and one of the beams 104 to advance and retract the platen 112. The motor 118 may be of any suitable type and is illustrated as of the hydraulic variety comprising a cylinder 120 fixed to one of the beams 104 and having a piston (not shown) therein rigid with a piston rod 122 secured to the frame 114.

The debander 96 also comprises a downwardly facing, upper movable platen 124 comprising a frame 126 having a plurality of elongate tooth members 127 thereon which are preferably substantially identical to the tooth members 116. The upper platen 124 is manipulated by a linear motor 130 which is likewise illustrated as of the hydraulic variety. The motor 130 accordingly includes a cylinder 132 secured to one of the beams 104 having therein a piston (not shown) rigid with a piston rod 134 connected to the frame 126. The platens 112, 124 are conveniently constrained by suitable guides (not shown) for linear movement toward and away from the bale 108.

In operation, a conventional gin bale is placed on the conveyor 90. A workman closes a suitable switch (not shown) to advance the belt 92 in the direction 94 until the bale 108 enters the debander 96 between the platen 112, 124 which are in their spaced apart position shown in FIG. 5. Workmen then square the bale 108 on the platework 106 so that the bands 136 are disposed between the slots 110. A suitable switch (not shown) is actuated to deliver hydraulic fluid to the motors 118, 130 to advance the platens 112, 124 toward each other. As the tooth members 116, 127 engage the bale 108 between the bands 136, the bale 108 is compressed and the bands 136 become slack. When the bands 136 become slack, the ends are unbuckled by workmen and the bands 136 removed, as by pulling the ends thereof in the direction indicated by the arrow 140 in FIG. 4.

At some time during handling of the bale 108 at the debanding station 64, it may be necessary to secure the bagging 128 to the ends of the bale 98. This may be done before the bale 98 is delivered into the debander 86 or may be done while the bale 98 is compressed therein. This operation is conducted conventionally as is well known to those skilled in the art.

One of the distinct advantages of the debander 96 is that the vertical sides of the bale 108 are accessible to workmen on both sides of the debander 96. As shown in FIG. 4, part of the pit 48 is decked over with planking 142. The area 144 is conveniently used by workmen when pulling the bands 136 from the bale 108. In addition, the area 144 is used by workmen when tucking the bagging 128. On the opposite side of the debander 96, the conveyor 90 does not obstruct access to the bale 108 so that workmen can also truck bagging from the area 146 on this side of the debander 96.

After all of the bands 136 are removed from the bale 108, the electric switch (not shown) is actuated to retract the motors 118, 130 to the position illustrated in FIG. 5. As soon as the press 72 has completed compressing of the bale therein, the debanded bale in the debander 96 is ready to be advanced into the press 72 by the feeding mechanism 78.

FEEDING MECHANISM

As shown best in FIGS. 4 and 5, the feeding mechanism 78 comprises a linear motor 148 of substantial stroke. Conveniently, the motor 148 is of the hydraulic variety comprising a cylinder 150 mounted on a frame 152 and having therein a piston (not shown) rigid with a piston rod 154 providing a plate like pusher member 156. The pusher member 156 is aligned with the bale 108 so that actuation of the motor 148 causes the pusher member 156 to advance from its retracted position shown in FIG. 5 through an intermediate position shown in FIG. 4 in order to push the debanded bale 108 in the direction indicated by the arrow 74 between the links 50, 52 and between the upstanding legs 40, 44 onto the platen 24 of the press 72. As the debanded bale moves onto the platen 24, it engages the bale compressed in the previous press cycle and moves it between the upstanding legs 38, 42 and between the links 54, 56 in the direction indicated by the arrow 74. It will accordingly be evident that the stroke provided by the motor 148 is quite long. Accordingly, the motor 148 may conviently comprise a compound hydraulic motor including a plurality of telescoping sections.

As the compressed bale from the previous press cycle exits from between the upstanding legs 38, 42, one end thereof falls downwardly onto the cross link 60 comprising part of the linkage 28. A workman may be positioned in the pit 48 to push the upper end of this bale in the direction indicated by the arrow 62 so that the bale falls onto a conveyor 158. The conveyor 158 includes an endless belt 160 which is conveniently endlessly driven in the direction of the arrow 162 to discharge the completed bale at or above ground level where it can be handled and removed by conventional bale handling equipment.

From this description, it will be seen that the path of bale movement through the improved press 70 of this invention is 90° out of phase with respect to the direction of movement 46 of the conventional Webb 80 press 10 illustrated in FIGS. 1 and 2.

HYDRAULIC POWER MECHANISM

Referring to FIG. 3, there is schematically illustrated an improved hydraulic power mechanism 84 of this invention. The steam power cylinder 32 as well as the steam control components 54, 56 are removed from the conventional Webb 80 press and replaced by a hydraulic power cylinder 164 having therein a piston (not shown) connected to the linkage arrangements 26, 28 in the same general manner as the conventional piston is connected. The hydraulic cylinder 164 is connected by a conduit 166 having a check valve 168 and a three way valve 170 therein to a pump or pumps 172 of suitable capacity. A conduit 174 connects the pump 172 to a reservoir 176 which is connected by a return conduit 178 to the three way valve 170.

During pressing operation, energization of the pump 172 withdraws hydraulic fluid from the reservoir 176 and delivers it under increased pressure through the conduit 166 and valve 170 to raise the piston (not shown) in the cylinder 164 and thereby raise the linkage arrangements 26, 28 to elevate the movable platen 24. To initiate downward movement of the platen 24, the three way valve 170 is indexed and the pump 172 deenergized. This allows hydraulic fluid in the cylinder 164 to pass through the conduit 166 and the return conduit 170 into the reservoir 176 thereby allowing the piston (not shown) in the cylinder 164 to move downwardly as caused by the weight of the linkage arrangements 26, 28 and the movable platen 24. Return movement of the platen 24 to its lowermost position is substantially the same in the improved press 70 as in the conventional press 10 since substantially the same components are influenced by gravity and move at substantially the same rate.

As mentioned previously, one advantage of hydraulically powering a Webb press is that movement of the platen 24 in the compressing direction is controllable by controlling the discharge from the pump 172.

This has two advantages. First, operation of the press is substantially safer. For example, accidents have occurred in the past where the leverman energized the steam cylinder 32 without a bale on the movable platen 24. Since the steam driven piston moves at an uncontrolled rate, significant damage is done to the press 10 as the movable platen 24 strikes the stationary platen 22 or the linkage arrangements 26, 28 reach the end of their intended stroke. This possibility may be precluded in a hydraulically driven Webb press since flow from the pump 172 may be metered during each cycle of operation and an automatic shutoff provided in the event the volume of hydraulic fluid exceeds a predetermined maximum value which is sufficient to raise the movable platen 24 to any reasonable extent prior to the occurrence of damage to the press 70.

Another significant advantage of hydraulically powering a Webb 80 press is that automation of the press can be accomplished to an extent which is quite impossible with steam power. This is likewise a result of the controllability of the pump 172.

AUTOMATIC BANDING STATION

Referring to FIG. 4, the automatic banding station 86 is illustrated. A plurality of automatic banding heads 180 are mounted on a carrier 182 immediately adjacent the wall 80 which acts, along the wall 82, to constrain a bale in the press 72. The automatic banding heads 180 are of conventional design and are available commercially from the Signode Corporation. Banding material 184 is threaded into each of the banding heads 180 in a conventional manner.

Each of the banding heads 180 includes a discharge 186 aligned with a pair of openings 188, 190 in the walls 80, 82 respectively. When a bale has been compressed between the platens 22, 24, the banding heads 180 are actuated to deliver banding material 184 through the aligned openings 188, 190 to secure one set of bands on the bale. The carrier 182 is mounted in a guideway for indexing movement in the direction of the arrow 192. The carrier 182 is then indexed by a motor 194 to place the discharge 186 of each of the banding heads 180 in alignment with a second series of aligned openings 196, 198 in the walls 80, 82 respectively. The banding heads 180 are then actuated to deliver a second series of bands onto the bale compressed between the platens 22, 24.

It will be appreciated by those skilled in the art that the banding material 184 is discharged from the banding heads and passes generally horizontally through the openings 188, 190. Suitable guide structure (not shown) is located adjacent the wall 82 to deflect the banding material along a first path in a generally upward direction and then into a second path located above the compressed bale so that the banding material again passes through the slots 190, 188 so that the free end of the banding material is again located adjacent the automatic banding head. The banding material accordingly has been looped around the compressed bale. The automatic banding station then cuts the banding material and crimps the two free ends together in a conventional manner.

It will be appreciate that indexing of the carrier 182 allows the use of a lesser number of the automatic banding heads 180. In the alternative, a single banding head may be provided for each of the pairs of slots in the walls 80, 82. Although a greater number of banding heads will be utilized, it will be appreciated that the overall cycle time through the modified press 72 will be reduced somewhat.

HEADING DEVICE

Figure 9:
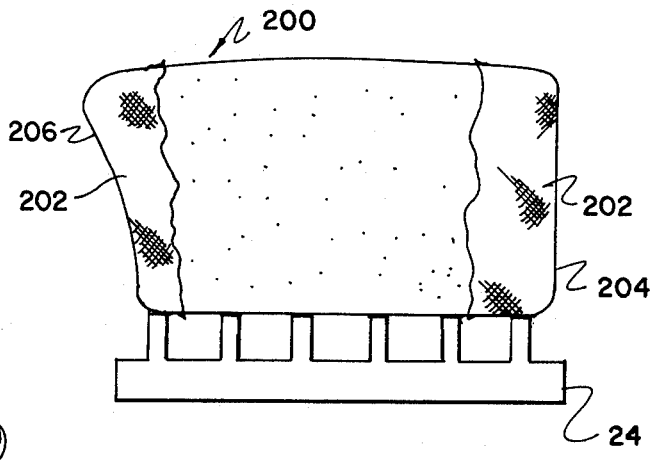
FIG. 9 is a side elevational view of an unbanded bale which has been pushed into the modified press of this invention without the use of a heading device.
Figure 10:
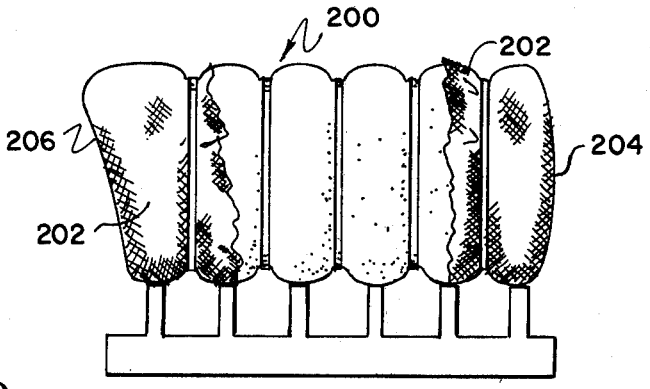
FIG. 10 is a side elevational view of a finished bale resulting from compressing and banding the bale of FIG. 8.

Referring to FIGS. 9 and 10, there is illustrated a phenomenon of the modified press 72 as heretofore described. As shown in FIG. 9, an unbanded bale 200 with its bagging material 202 temporarily secured thereto has been pushed onto the platen 24 by the pusher member 156 of the feeding mechanism 78. Presumably because of friction and mechanical interference between the bottom of the bale 200 and the platen 24, the unbanded bale 200 has assumed a somewhat trapezoidal configuration in which one end 204 of the bale 200 is generally vertical but the other end 206 is inclined.

As shown in FIG. 10, a completed bale, immediately after compressing and banding, assumes a similar generally trapezoidal configuration. The disadvantage is that the banded bale 200 shown in FIG. 10 cannot be stood vertically on the ground with the bale end 206 down. A similar problem is that compressed bales of the configuration shown in FIG. 10 cannot be stood vertically and stacked one on top of another without running a substantial risk that the upper tier of bales will fall over.

Figure 11:
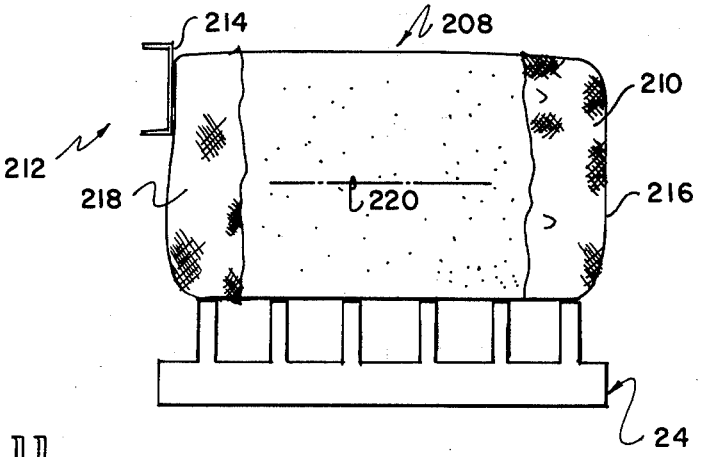
FIG. 11 illustrates an unbanded bale which has been pushed into the modified press of this invention and its relationship with the heading device of FIGS. 6 and 7.

In order to cure this condition, there is provided a heading device which acts to square the unbanded bale on the platen 24 as a consequence of feeding movement into the press 72. The operation of the heading device of this invention is shown schematically in FIG. 11 where an unbanded bale 208 having bagging material 210 thereon has been pushed onto the platen 24 by the feeder mechanism 78. As the bale 208 approaches its compressing position on the platen 24, a heading device 212 is actuated to position a generally flat abutment 214 against the upper forward portion of the bale 208. The abutment 214 is then forceably advanced against the bale 208 while the bale end 216 remains in contact with the pusher member 156 of the feeder mechanism 78. In this fashion, the forward bale end 218 is squared so that the bale ends 216, 218 are generally perpendicular to the bale axis 220. Accordingly, the banded bale can be stood upright on either end and the bales may be stacked one on top of another in a reliably stable manner.

Referring to FIGS. 7 and 8, two different embodiments of the heading device are illustrated. In FIG. 7, the heading device 212 is illustrated as comprising the abutment 214 mounted on a link 222 connected by a pin 224 and bracket 226 to the frame 228 of the press 72. The abutment 214 is connected to a rod 230 of a hydraulic motor 232. The cylinder 234 of the motor 232 is connected by a pin 236 and bracket 238 to the press frame 228. It will accordingly be seen that the abutment 214 swings, in a rather limited fashion, about the pin 224 upon energization of the hydraulic motor 232 to square the unbanded bale 208. A preferred embodiment 240 of the heading device is illustrated in FIG. 8 and comprises an abutment 242 rigid with a rod 244 of a hydraulic motor 246. The abutment 242 carries a bracket 248 having a plurality of rollers 250 thereon received in a linear guideway 252 rigid with the press frame 228. The cylinder 254 of the motor 246 is rigidly connected to the guideway 252, as by welding or the like.

Although the invention has been described in its preferred forms with a certain degree of particularity, it is understood that the disclosure of the preferred embodiments has been made only by way of example and numerous changes in the details of construction, combination and arrangement of parts, and mode of operation may be resorted to without departing from the spirit and scope of the invention as hereinafter claimed. It is intended that the patent shall cover, by suitable expression in the appended claims, whatever features of patentable novelty exist in the invention disclosed.

I claim:

1. A cotton press adapted to receive a debanded bale for compressing the same to a configuration to receive bands therearound, the press being of the Webb type incorporating a frame having a pair of aligned spaced inverted U-shaped members; a movable platen mounted for upward movement toward a stationary platen; and means for forcing the movable platen upwardly toward the stationary platen including a vertically mounted piston-cylinder arrangement and a linkage mechanism interconnecting the piston-cylinder arrangement and the movable platen, the linkage mechanism comprising first and second pairs of links on opposite ends of the U-shaped members, each of the links being generally aligned with one of the U-shaped members, the improvement comprising means providing cotton movement through the press in a path between the spaced inverted U-shaped members including means for feeding a debanded cotton bale between the links of the first link pair toward a pressing location between the platens and for moving a banded cotton bale between the links of the second link pair away from the pressing location.

2. The cotton press of claim 1 further comprising a pair of walls substantially spanning each U-shaped frame member and a plurality of automatic banding heads carried adjacent one of the walls for banding compressed cotton bales between the platens.

3. The cotton press of claim 1 further comprising a debanding station on one side of the press and wherein the feeding means comprises means for pushing a debanded bale out of the debanding station into a path of movement between the links of one of the pairs into the pressing location.

4. The cotton press of claim 1 further comprising means perpendicular to the path of movement for engaging and squaring a debanded bale adjacent the pressing location prior to actuation of the piston-cylinder arrangement.

5. The cotton press of claim 4 wherein the means perpendicular to the path of movement comprises an abutment.

6. The cotton press of claim 5 wherein the abutment is positioned for engaging the upper end of the debanded bale adjacent the stationary platen at the pressing location and wherein the squaring means further comprises means for moving the abutment away from the debanded bale.

7. The cotton press of claim 6 wherein the squaring means further comprises means for forcing the abutment against the unbanded bale.

8. The cotton press of claim 6 wherein the abutment moving means includes means for retracting the abutment prior to movement of the movable platen.

9. The cotton press of claim 4 wherein the squaring means comprises an abutment having a flat end perpendicular to the path of movement, means mounting the abutment for movement between a first location abutting the debanded bale and a second location spaced from the debanded bale, and means for advancing the abutment between its first and second positions.

10. The cotton press of claim 1 wherein the feeding means comprises means for feeding a debanded cotton bale into the pressing locations and concurrently pushing a banded cotton bale out of the pressing location in a path of movement between the links of the other pair.

11. The cotton press of claim 10 wherein the frame rests on an underlying surface providing a depression adjacent the other pair of links into which the banded bale drops during movement away from the pressing location and further comprising conveyor means extending into the depression for elevating the banded bale out of the pit to a location adjacent the underlying surface.

12. The cotton press of claim 11 wherein the conveyor means comprises an inclined endless conveyor.

13. The cotton press of claim 1 comprising a path of bale discharging movement away from the pressing location between the links of the other pair, the frame resting on an underlying surface providing a depression adjacent the second pair of links into which the banded bale drops during bale discharging movement and further comprising conveyor means for elevating the banded bale out of the depression.

14. A cotton press of the Webb type incorporating a frame having a pair of aligned spaced inverted U-shaped members defining a first path of cotton movement therethrough; a stationary platen carried between the U-shaped members; a movable platen mounted for upward movement toward the stationary platen; and means for forcing the movable platen upwardly toward the stationary platen including a vertically mounted piston-cylinder arrangement and a linkage mechanism interconnecting the piston-cylinder arrangement and the movable platen; the improvement comprising means blocking the first path of cotton movement; and means for effecting cotton movement from one end of the press, through the press and out the other end in a path substantially perpendicular to the first path.

15. A debanding station for removing banding material from bales including a debanding press, comprising a frame having a plurality of upstanding support members spaced apart to accommodate a width dimension of the bale;

a generally horizontal support plate carried by the frame providing a plurality of spaced openings extending in the direction of the bale width dimension;

a lower movable platen comprising a framework having a plurality of projections sized to pass through the openings and means for moving the lower platen from a first retracted position where the projections are located below the top of the support plate and a second position where the projections extend through the slots;

an upper platen comprising a framework having a plurality of projections generally vertically aligned with the slots; and means for forcing the upper and lower platens toward each other into compressing contact with the bale for compressing the bale and relaxing tension on the banding material, the projections on the lower platen passing through the openings to engage the bale between the banding material and the projections on the upper platen engaging the bale between the banding material.

16. The debanding station of claim 15 further comprising means for moving the upper platen downwardly toward the lower platen contemporaneously with movement of the lower platen toward the second position.

17. The debanding station of claim 15 further comprising an inlet conveyor including an endless belt having a discharge end in bale transferring relation to the support plate.

18. The debanding station of claim 17 wherein the bale presents vertical sides and ends when in the support plate, the debanding station and press being substantially unobstructed adjacent the vertical bale sides.

* * * * *